United States Patent [19]

Reifenhäuser et al.

[11] 4,051,757

[45] Oct. 4, 1977

[54] DICING MACHINE

[75] Inventors: Toni Reifenhäuser, Burglahr; Helmut Walter Maus, Oberlahr, both of Germany

[73] Assignee: Toni Reifenhäuser, Burglahr, Germany

[21] Appl. No.: 680,477

[22] Filed: Apr. 26, 1976

[30] Foreign Application Priority Data

May 6, 1975 Germany ..... 2520068

[51] Int. Cl.[2] ..... B26D 3/26

[52] U.S. Cl. ..... 83/404.3; 83/404.4; 83/408; 83/425.2; 83/437

[58] Field of Search ..... 83/404.2, 404.1, 437, 83/425.2, 408, 425.1, 404.3, 404

[56] References Cited

U.S. PATENT DOCUMENTS

| | | | |
|---|---|---|---|
| 57,111 | 8/1866 | Forshner | 83/404.3 |
| 1,187,561 | 6/1916 | Sorensen | 83/437 |
| 1,251,885 | 1/1918 | Hanusch | 83/437 |
| 1,771,496 | 7/1930 | Leguillon | 83/437 |
| 2,120,375 | 6/1938 | Shaver et al. | 83/437 |
| 2,341,582 | 2/1944 | Turner | 83/425.1 |

*Primary Examiner*—Donald R. Schran
*Attorney, Agent, or Firm*—Arthur B. Colvin

[57] ABSTRACT

A dicing machine for cutting foodstuffs, such as meat, bacon and the like into cubes and having a magazine which is rectangular in cross section and which receives the commodity that is to be cut and which has a filling aperture extending substantially over its length and in which a movable ram forces the commodity against a lattice-work of knives arranged at one open end of the magazine.

11 Claims, 12 Drawing Figures

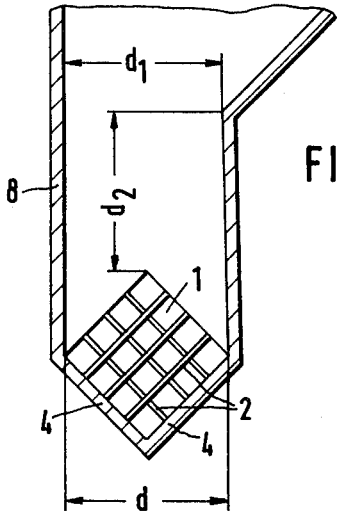
FIG. 5
FIG. 6
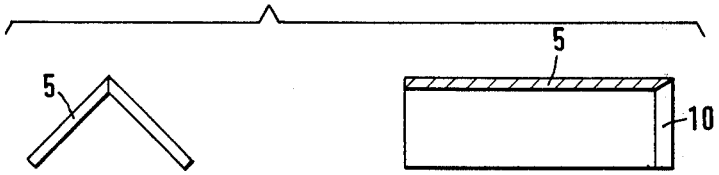
FIG. 7
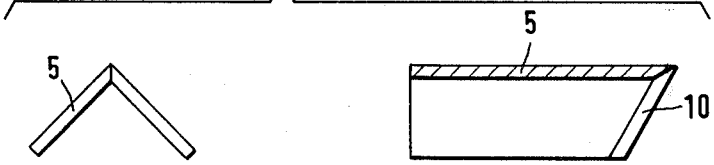
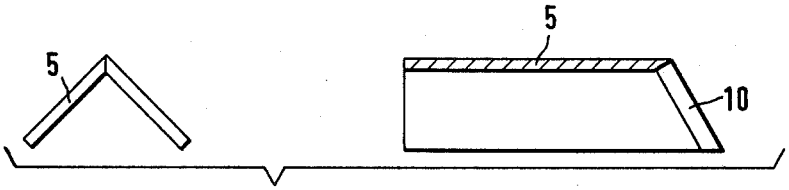
FIG. 8

DICING MACHINE

In a known dicing machine of the above type, which works satisfactorily insofar as the actual cutting procedure is concerned, faults occur again and again in magazine charging, because the commodity that is to be cut, more especially unsplit sides of bacon, has a strong tendency to adhere, so that in the hopper that is usually arranged above the charging magazine bridges occur which prevent the onward transportation of the commodity to the magazine. Apart from the need for frequent manual intervention, congestion in the commodity transportation is often only perceived after an idle-run of the lattice-work knives has indicated the inadequate charging of the magazine.

To prevent charging breakdown as a result of congestion of the commodity in the hopper, it has already been proposed to design at least one of the hopper walls to be so movable that it forces the commodity downwards in the manner of a shaking chute and finally rams through the hopper outlet. Even if good results have been achieved with this hopper construction, this solution is however very expensive and also requires additional maintenance and, more especially, considerable work upon the cleaning of the machine, since for this the increased number of moving parts has to be dismantled and installed once more in the cleaned state.

The present invention has as its object the provision of a cube cutting machine for foodstuffs, such as meat, bacon and the like, which in a simple manner guarantees a quantitatively constant charging of the magazine and without additional means completely or substantially prevents congestion in transportation of the commodity.

The invention provides a dicing machine for foodstuffs, such as meat, bacon and the like, having a magazine which is rectangular in cross-section and which receives the commodity that is to be cut and which has a filling aperture extending substantially over its length and in which a movable piston forces the commodity against lattice-work knives arranged at one open end of the magazine, wherein one cross-sectional diagonal of the magazine extends horizontally and its length determines the width of the filling aperture which is closable by a roof-angle-shaped slider which is movable parallel to the piston and which is equipped with two front cutting edges.

Through the diagonal arrangement, in accordance with the invention, of the magazine, the free cross-section of the magazine is considerably enlarged, so that the danger of congestion at the filling aperture, which is time and again considered as the narrow point of the conveying path is considerably reduced. In addition to this, however, also the design of the slider destroys upon each closing movement any possible bridge formation in the commodity that is to be cut, since the slider separates any bridge arch from the rest of the commodity and encloses same in the magazine.

A further development of the invention provides that arranged above the filling aperture of the magazine is a filling shaft whose height exceeds the cross-sectional diagonal of the magazine which is equal to or greater than the width of the upper aperture of the filling shaft.

Instead of the direct connection of a hopper which narrow conically downwards, in the present invention a filling shaft is preferably connected to the filling aperture, the horizontal cross-section of the shaft, in contrast to the typical hopper design being either constant, or slightly increases downwards, so that the shaft, filled without haste during the cutting procedure of a portion of commodity, can spontaneously empty itself upon the drawing back of the slider into the open position of the magazine, since the commodity, instead of having to slide over wallings of the fillings shaft, falls freely into the magazine.

With this design of the filling shaft (even without the diagonal arrangement and enlargement of the filling aperture of the magazine) the danger of congestion can largely be obviated, since bridge formation, feared in the customary hopper-shaped design of the charging members, is as good as precluded. The slower filling of the shaft that has to be accepted in this respect in no way impairs the performance of the machine, since the filling can be undertaken during the cutting of the charge already in the magazine.

An advantageous development of the invention provides for the fact that filling shaft and the immovable magazine longitudinal walls lying opposite the slider are integral.

Through the design in accordance with the invention, the magazine and the filling shaft can not only be produced in a particularly economical manner, but can also be well and simply cleaned.

In order to be able to sever the magazine charge from the rest of the content of the filling shaft, a further development of the invention provides that the front edges of the slider extend in a straight line or drawn forward or back in arrow-shaped manner in an arc from the common starting point of the edges.

A particularly inherently stable version of the roof-angle-shaped slider can thereby be achieved when, in accordance with a further development of the invention, the slider is supplemented into a square profile guided at the bottom on the magazine longitudinal walls.

So that the knife-shaped front edges of the slider can continue the cutting procedure right into the closure position of the magazine, without suffering damage in so doing, in accordance with a further development of the invention arranged on the magazine is a plastics profile, so that the full length of the front edges of the slider butt against it in the closed position.

To facilitate the separation procedure and more especially to avoid maceration of the commodity, a further development of the invention additionally provides that associated with the edges of the slider in the closure position there are, on the magazine, stationary or transversely-movable knife edges.

The invention will be described further, by way of example, with reference to the accompanying drawings, wherein:

FIG. 5 is a section taken along the line V—V of FIG. 2;

FIGS. 6, 7 and 8 show different designs of slider 5;

Figure 9:
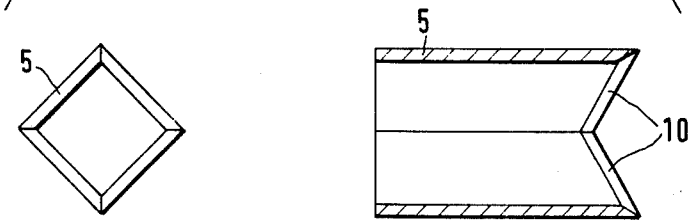
Figure 10:
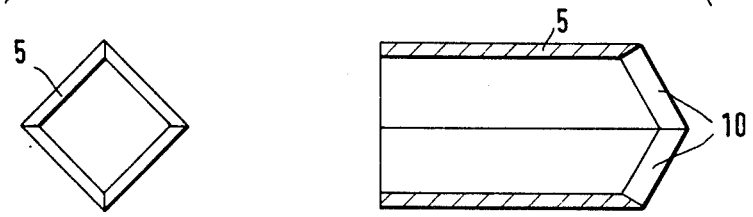
Figure 11:
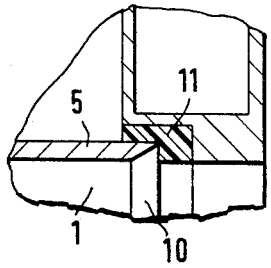
Figure 12:
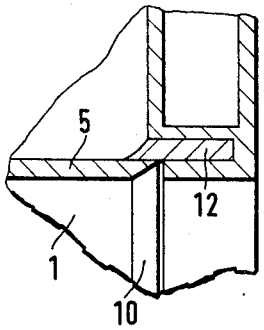

FIGS. 9 and 10 each show a slider supplemented into a square profile, having a respective differently shaped front edge; and FIG. 11 and 12 show differently fashioned surroundings of the front edges of the slider in the closed position.

Figure 1:
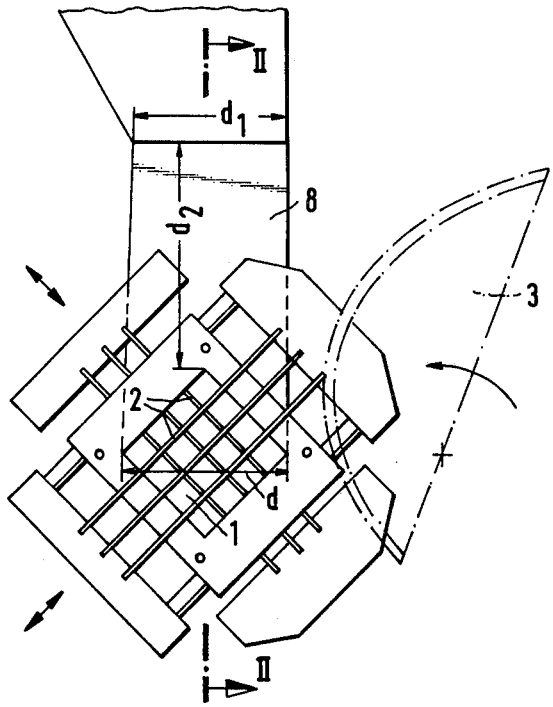
FIG. 1 is a front view of a preferred embodiment of the invention.

As shown by FIG. 1, arranged on one end face of a magazine 1, which is rectangular in cross-section and whose cross-sectional *d* extends horizontally, are lattice-work knives 2 in such a way that meat or bacon is ejected from the magazine 1 in uniform rectangular strips, which a knife 3 with an arcuate cutting edge which sweeps over the end face of the magazine 1, subdivides into cubes.

The magazine 1 is, as shown more especially by FIG. 5, bounded downwardly by two longitudinal walls 4 which are arranged at a right angle to one another, and coverable upwardly by a roof-angle-shaped slider 5.

A piston 6 adapted to the cross-section of the magazine 1 is shifted to and fro with the aid of a ram 7 over the length of the magazine 1.

Arranged above the filling aperture, which is determined in width by the cross-sectional diagonal *d* of the magazine 1, is a filling shaft 8 which, as shown by FIG. 5, is preferably designed in one piece with the longitudinal walls 4 of the magazine 1.

The width $d_1$ of the upper aperture of the filling shaft 8 is somewhat smaller than the cross-sectional diagonal *d*, whereas the height $d_2$ of the filling shaft 8, measured from the apex of the roof-shaped slider 5, is greater than the cross-sectional diagonal *d*. Through these dimension(ing) ratios it is ensured that the filling shaft 8 can both accept a sufficient quantity of the commodity to be cut to fill the magazine and to let this drop spontaneously into the magazine 1 without frictional resistance, as soon as the slider 5 is in the drawn-back position shown in FIG. 2.

Figure 2:
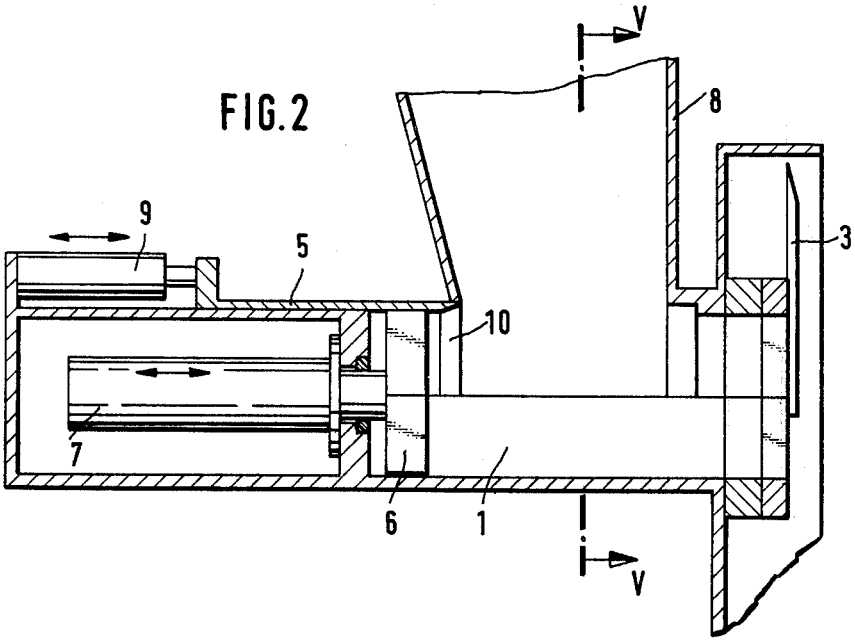
FIG. 2 is a section taken along the line II—II of FIG. 1.
Figure 3:
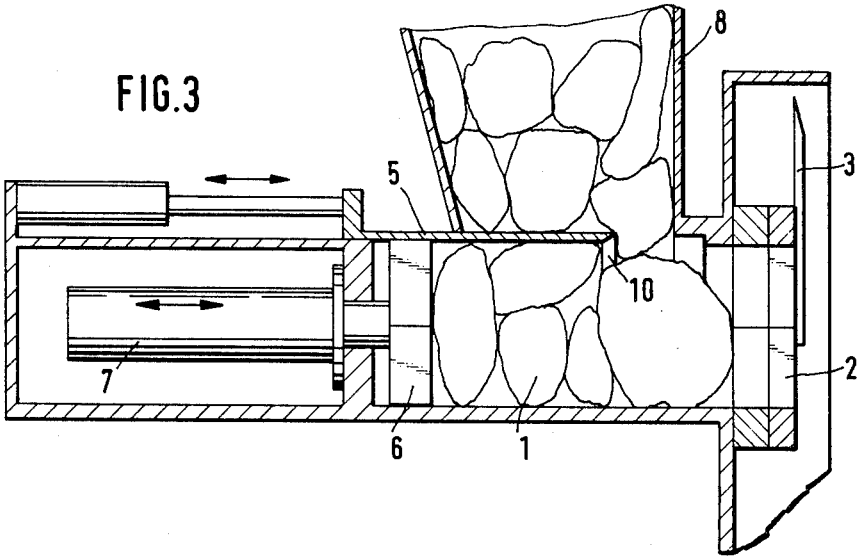
FIG. 3 is a section in accordance with FIG. 2 with the magazine half closed.
Figure 4:
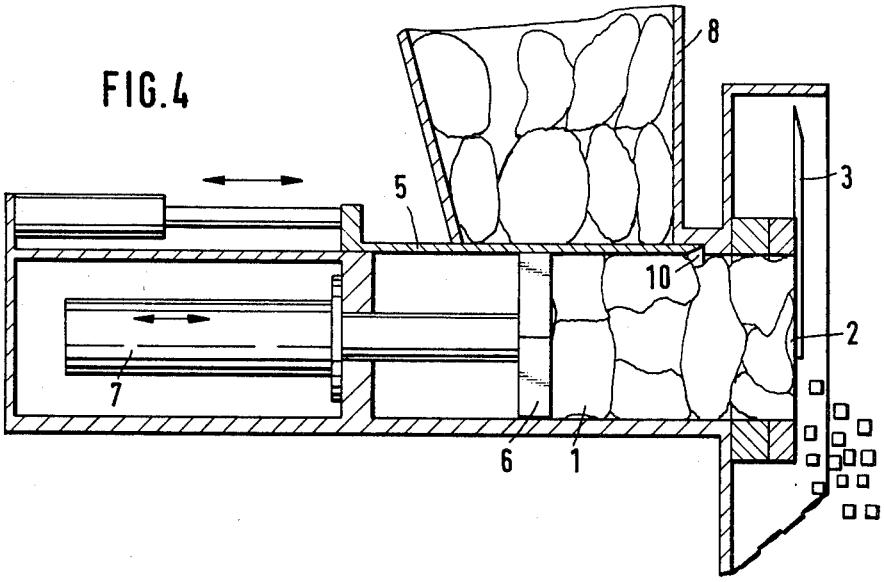
FIG. 4 is a section in accordance with FIG. 2 with the magazine closed and already approximately half emptied.

As shown in FIGS. 2, 3 and 4, the actuation of the slider 5 is effected with the aid of a ram 9, which is similar to the ram 7 for the piston 6. The possibility also exists of connecting the two drives 7 and 9 together or so coupling same that alternately the slider 5 and the piston 6 are actuated.

The slider 5 has, on the side lying opposite the drive 9, front edges 10 which are cutting edges and which, in contradistinction to the exemplified embodiment in accordance with FIG. 6, can extend forward or backwards in arrow-shaped manner from their apex, as is shown in FIGS. 7 and 8.

Finally, the slider 5 with the afore-described cutting edge can also be made into a closed square profile as is shown in FIGS. 9 and 10.

For the protection of the knife-shaped front edges 10, these strike, as shown in FIG. 11, against a plastic profile 11 or cooperate in the end phase of the cutting and closing procedure with knife edges 12 which are arranged stationarily on the magazine 1, as is shown in FIG. 12.

Having now described out invention, what we claim as new and desire to secure by Letters Patent of the United States is:

1. A dicing machine for foodstuffs, such as meat, bacon and the like having a magazine which is rectangular in cross-section and which receives the foodstuff that is to be cut, said magazine having a filling aperture extending substantially over its length, lattice-work knives arranged at one open end of the magazine, a piston movable into the magazine to force the foodstuff against said lattice-work knives for extrusion of the foodstuff in strips, one cross-sectional diagonal of the magazine extending horizontally, the length of said diagonal determining the width of the filling aperture and a roof-angle-shaped slider to close said filling aperture, said slider being movable parallel to said piston and having two front cutting edges.

2. A machine as claimed in claim 1, characterized in that there is arranged above the filling aperture of the magazine, a filling shaft whose height exceeds the cross-sectional diagonal of the magazine, the width of the upper aperture of the filling shaft being at least equal to the width of said cross-sectional diagonal.

3. A machine as claimed in claim 2, wherein the magazine has a fixed longitudinal wall and the filling shaft is integral with the fixed magazine longitudinal wall, facing the slide.

4. A machine as claimed in claim 1, wherein the front edges of the slider extend in a straight line.

5. A machine as claimed in claim 4, wherein the slider is extended to a square profile guided at the bottom on the magazine longitudinal walls.

6. A machine as claimed in claim 1, in which a plastic material profile is provided and the cutting edges of the slider strike, in the closed position of the magazine, against said plastic material profile.

7. A machine as claimed in claim 1, where there are associated with the cutting edges of the slider, in the closed position, stationary knife edges on the magazine.

8. A machine as claimed in claim 1 in which means are provided transversely to cut the strips extruded through the lattice-work.

9. A machine as claimed in claim 1, characterized in that there is arranged above the filling aperture of the magazine, a filling shaft whose height exceeds the cross-sectional diagonal of the magazine, the width of the upper aperture of the filling shaft being greater than the width of said cross-sectional diagonal.

10. A machine as claimed in claim 1 wherein the front edges of the slider are drawn forward from the apex of the edges.

11. A machine as claimed in claim 1 wherein the front edges of the slider are drawn backward from the apex of the edges.

* * * * *